US009284103B2

(12) United States Patent
Couchey et al.

(10) Patent No.: US 9,284,103 B2
(45) Date of Patent: Mar. 15, 2016

(54) END SUPPORT FOR WOUND ROLLS

(71) Applicant: Sonoco Development, Inc., Hartsville, SC (US)

(72) Inventors: Brian P. Couchey, Inman, SC (US); Chad E. Lagace, Cohoes, NY (US)

(73) Assignee: Sonoco Development, Inc., Hartsville, SC (US)

( * ) Notice: Subject to any disclaimer, the term of this patent is extended or adjusted under 35 U.S.C. 154(b) by 266 days.

(21) Appl. No.: 14/072,235

(22) Filed: Nov. 5, 2013

(65) Prior Publication Data

US 2015/0122684 A1 May 7, 2015

(51) Int. Cl.

| | |
|---|---|
| ***B65H 75/14*** | (2006.01) |
| ***B65D 59/08*** | (2006.01) |
| ***B65D 85/672*** | (2006.01) |
| ***B65H 75/18*** | (2006.01) |
| ***B65D 59/02*** | (2006.01) |
| ***B65D 85/66*** | (2006.01) |

(52) U.S. Cl.

CPC ..... *B65D 59/08* (2013.01); *B65D 59/02* (2013.01); *B65D 85/66* (2013.01); *B65D 85/672* (2013.01); *B65H 75/185* (2013.01); *B65H 2701/5122* (2013.01)

(58) Field of Classification Search

CPC ..... B65H 75/14; B65H 75/18; B65H 75/185; B65H 2701/5122; B65H 2701/5136; B65D 11/20; B65D 59/08; B65D 85/66; B65D 85/672; B65D 59/02; B65D 21/0202; B65D 21/0212

USPC ..... 242/614, 614.1, 613.4, 596.8; 206/389, 206/413, 414, 415, 416

See application file for complete search history.

(56) References Cited

U.S. PATENT DOCUMENTS

| | | | |
|---|---|---|---|
| 3,260,362 | A | 7/1966 | Schwinne |
| 3,756,392 | A | 9/1973 | Oehlmann |
| 4,042,108 | A | 8/1977 | Brethauer |
| 4,253,570 | A | 3/1981 | O'Connor et al. |
| 4,291,802 | A | 9/1981 | Buelens |

(Continued)

FOREIGN PATENT DOCUMENTS

| | | | |
|---|---|---|---|
| EP | 0447737 | B1 | 9/1991 |
| JP | 2001-199639 | A | 7/2001 |

(Continued)

OTHER PUBLICATIONS

EP Search Report for EP Appln No. 14 19 1741, filed Nov. 4, 2014, report completed Mar. 4, 2015.

*Primary Examiner* — William A Rivera
(74) *Attorney, Agent, or Firm* — Flaster/Greenberg P.C.

(57) ABSTRACT

An end support for supporting a roll of material wound on a tubular core is defined by a generally rectangular plate and a projecting hub member. The hub is dimensioned for insertion into a tubular core material roll. A plurality of spaced plate ribs are provided internally within the plate with at least one rib extending inwardly from each of the plate side perpendicular to the hub member. A plurality of crossing ribs are also provided and intersect with the perpendicular plate ribs and other crossing ribs to define a generally open areas lattice pattern. A plurality of corrugation surfaces are fixed to one or more of the side members, corner members, hub member, crossing ribs and plate ribs and extend into the open areas of the lattice pattern. The corrugations surfaces are alternately formed along the front and rear faces of the plate.

20 Claims, 7 Drawing Sheets

(56) References Cited

U.S. PATENT DOCUMENTS

| | | | | |
|---|---|---|---|---|
| 4,771,889 | A * | 9/1988 | Bauer | B65D 85/671 206/390 |
| 4,787,513 | A | 11/1988 | Auble et al. | |
| 4,877,133 | A | 10/1989 | Klenter et al. | |
| 4,878,581 | A | 11/1989 | Beery | |
| 4,884,690 | A | 12/1989 | Klenter et al. | |
| 4,903,833 | A | 2/1990 | Beery | |
| 5,097,951 | A | 3/1992 | Pigott et al. | |
| 5,100,076 | A | 3/1992 | Cobane et al. | |
| 5,205,411 | A | 4/1993 | Born et al. | |
| 5,275,346 | A | 1/1994 | Dominesey et al. | |
| 5,344,013 | A | 9/1994 | Born et al. | |
| 5,409,180 | A | 4/1995 | Stewing | |
| 5,415,289 | A | 5/1995 | Kim | |
| 5,421,537 | A | 6/1995 | Cobane et al. | |
| 5,431,282 | A | 7/1995 | Kremp et al. | |
| 5,620,093 | A | 4/1997 | Born | |
| 5,718,397 | A | 2/1998 | Stevens | |
| 5,779,186 | A | 7/1998 | Bakker et al. | |
| 5,829,592 | A | 11/1998 | Henry, Jr. et al. | |
| 5,897,075 | A | 4/1999 | Elder et al. | |
| 6,315,122 | B1 | 11/2001 | McCord et al. | |
| 6,398,154 | B1 | 6/2002 | Cox et al. | |
| 6,715,710 | B1 | 4/2004 | Russell et al. | |
| 6,874,726 | B2 | 4/2005 | Ripplinger | |
| 6,991,197 | B2 | 1/2006 | Cox et al. | |
| 6,994,291 | B2 | 2/2006 | Kemp et al. | |
| 7,204,452 | B2 | 4/2007 | Wilkinson et al. | |
| 7,341,220 | B2 | 3/2008 | Katayama | |
| 7,364,113 | B2 | 4/2008 | Ripplinger | |
| 7,556,217 | B2 | 7/2009 | Ripplinger | |
| 7,938,357 | B2 | 5/2011 | Johanson et al. | |
| 8,286,906 | B2 | 10/2012 | Ripplinger | |
| 8,424,795 | B2 * | 4/2013 | Galgano | B62B 1/14 242/588.6 |
| 2002/0148925 | A1 | 10/2002 | Cox et al. | |
| 2002/0166937 | A1 | 11/2002 | Colton | |
| 2003/0183718 | A1 | 10/2003 | Davis et al. | |
| 2003/0197087 | A9 | 10/2003 | Cox et al. | |
| 2004/0050996 | A1 | 3/2004 | Russell et al. | |
| 2005/0077423 | A1 | 4/2005 | Cox et al. | |
| 2012/0153069 | A1 | 6/2012 | Allwood | |

FOREIGN PATENT DOCUMENTS

| | | | |
|---|---|---|---|
| JP | 2003-089477 | A | 3/2003 |
| JP | 2012-446555 | A | 6/2012 |

* cited by examiner

END SUPPORT FOR WOUND ROLLS

FIELD OF THE INVENTION

The present disclosure relates to an end support for roll of material formed on a tubular core.

BACKGROUND

Support structures forming an end wall for a roll of material are known. The end wall structure typically includes a plate element with a formed hub. The hub has a defined outer dimension that permits it to be inserted into the tubular core. An end wall is positioned on each end of the roll.

U.S. Pat. No. 5,620,093 to Born shows an end wall made from a formable material having a generally rectangular plate with a plurality of ribs formed within the plate. A separate hub member is inserted into a central opening formed in the plate.

U.S. Pat. No. 4,291,802 to Buelens shows a light-tight cassette having an outer housing and two end walls. The end walls include a central hub for supporting a reel structure within the housing. A peripheral groove is provided on the end walls for receipt of the housing to form the enclosure. Multiple ribs are providing in the body of the end walls.

U.S. Pat. No. 6,315,122 to McCord et al. shows a stacking system for rolls of wound material. The end walls include a central opening for receipt of a core projecting from the ends of the roll. A rib structure is provided within the body of the end walls.

US 2002/0166937 to Colton shows an end support structure for wound rolls of material. The end supports include a perpendicular flange, a plurality of radially extending ribs and a central hub.

SUMMARY OF THE INVENTION

The present disclosure relates to an end support for supporting a material roll. The roll may be formed from a wound web of material formed on a tubular core. The roll is preferably supported by two end supports in a substantially horizontal orientation. In one form, the end supports include a substantially planar plate member having a front face and a rear face, the two faces spaced from one another. An outer flange defines a number of side surfaces for the palate and defines a generally rectangular periphery. The flange extends transverse to the plane of the plate and an internal area within its periphery. A hub member is provided on the plate and includes an outer dimension for insertion into the tubular core of material roll. The hub is preferably positioned centrally within the internal area and projects outwardly from the front face and from the plane of the plate. A plurality of spaced plate ribs are formed transverse to the plane of the plate and are positioned within the internal area. The plate ribs extend inwardly from the flange to the hub. Open areas are defined between the plate ribs. A least one of the plate ribs extend substantially perpendicular to each of the rectangular side surfaces of the peripheral flange. The perpendicular ribs are further aligned radially with the hub. Corrugation surfaces are fixed to the ribs and extend from the ribs at least partially into the open area between the ribs. The corrugation surfaces are alternately formed along the front and rear faces.

In a further aspect of the end support, the hub may include a plurality of hub ribs formed internally within the hub. Further, the hub ribs may be aligned with the perpendicular side ribs and may extend only partially into a central area formed by the hub.

In another aspect of the end support, the rim may be formed substantially rectangular in shape, with the side surfaces being four flat side members and with rounded corners provided to connect the side members.

In a further aspect of the end support, the plate ribs may include a plurality of radial ribs extending radially between the hub and the corners of the peripheral flange. The plate ribs may further include a plurality of parallel ribs positioned within the internal area and aligned substantially parallel to the side surfaces of the peripheral flange. The various parallel ribs preferably intersect with the perpendicular side ribs and form an open lattice structure. Further, the corrugation surfaces may have a rectangular form within the lattice openings.

In a further aspect of the end support, the side surfaces of the plate may each comprise an undulating finger portion within the flange wall for ease of gripping the plate for carrying the plate or package.

In a further aspect of the disclosure an end support is defined for supporting a roll of material that is wound on a tubular core. The end supports are provided on opposite ends of the roll and preferably support the roll in a substantially horizontal orientation. The end supports are formed by a plate having four side members, defining in combination a generally rectangular profile, and four corner members, with each corner connecting two side members. The plate includes a front face and a rear face, with the front and rear faces being spaced from one another by a plate thickness. A hub member is provided for insertion into a tubular core of the roll of material. The hub is preferably positioned centrally within the rectangular profile of the plate and projects substantially perpendicular from the front face of the plate. A plurality of spaced plate ribs are provided internally within the rectangular profile of the plate. At least one of the plate ribs extends inwardly from each of the side members in a substantially perpendicular direction therefrom. Each of the perpendicular plate ribs are connected to the hub member. In combination, the side members, corner members, hub member and plate ribs define generally open areas there between. A plurality of corrugation surfaces are fixed to one or more of the side members, corner members, hub member and plate ribs and extend at least partially into the open areas. The corrugation surfaces are alternately formed along the front and rear faces of the plate.

In a further aspect of the end support a plurality of plate ribs are provided and intersect with the perpendicular plate ribs to form an open lattice structure having a plurality of rectangular openings. A plurality of plate ribs may further extend inwardly from the corner members or from the side members at an acute angle.

In a further aspect of the end support the hub member is generally cylindrical. Further, the perpendicular ribs are preferably aligned with a radius of the cylindrical hub member. The hub may further include a plurality of hub rib portions formed internally within the hub. A number of the hub ribs may further be aligned with the perpendicular plate ribs and the hub ribs may extend only partially into the central are of the hub.

In a further aspect of the end support the side members may include four substantially flat side surfaces and the corners members may be formed as outwardly convex connecting members.

Other features and variations of the assembly will become apparent by a review of the disclosure below.

BRIEF DESCRIPTION OF THE DRAWINGS

For the purpose of illustrating the invention, there is shown in the drawings one or more forms that are presently preferred; it being understood that the invention is not limited to the precise arrangements and instrumentalities shown.

DETAILED DESCRIPTION

Figure 1:
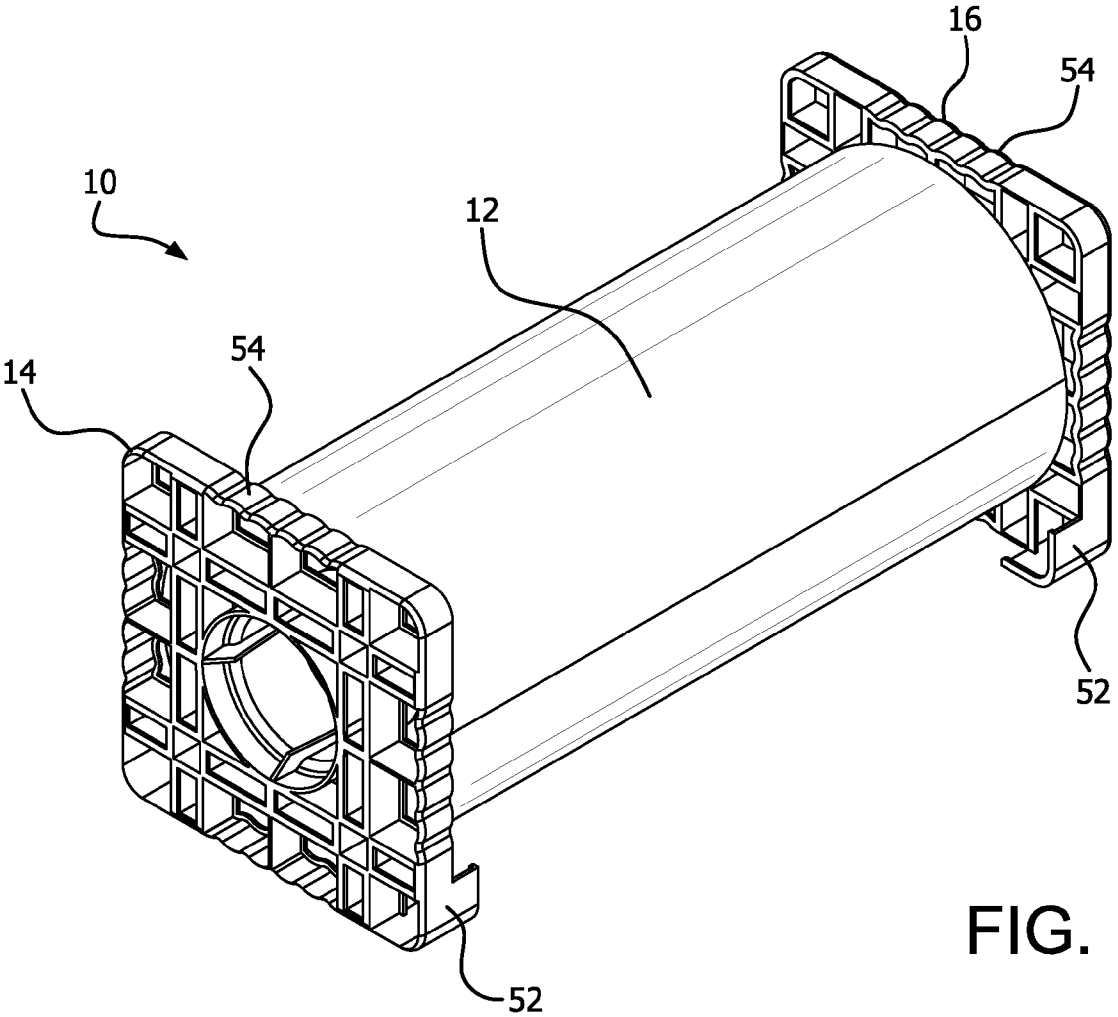
FIG. 1 is a top perspective view of a package including a roll of material and two end supports or plates formed according to the present disclosure.
Figure 2:
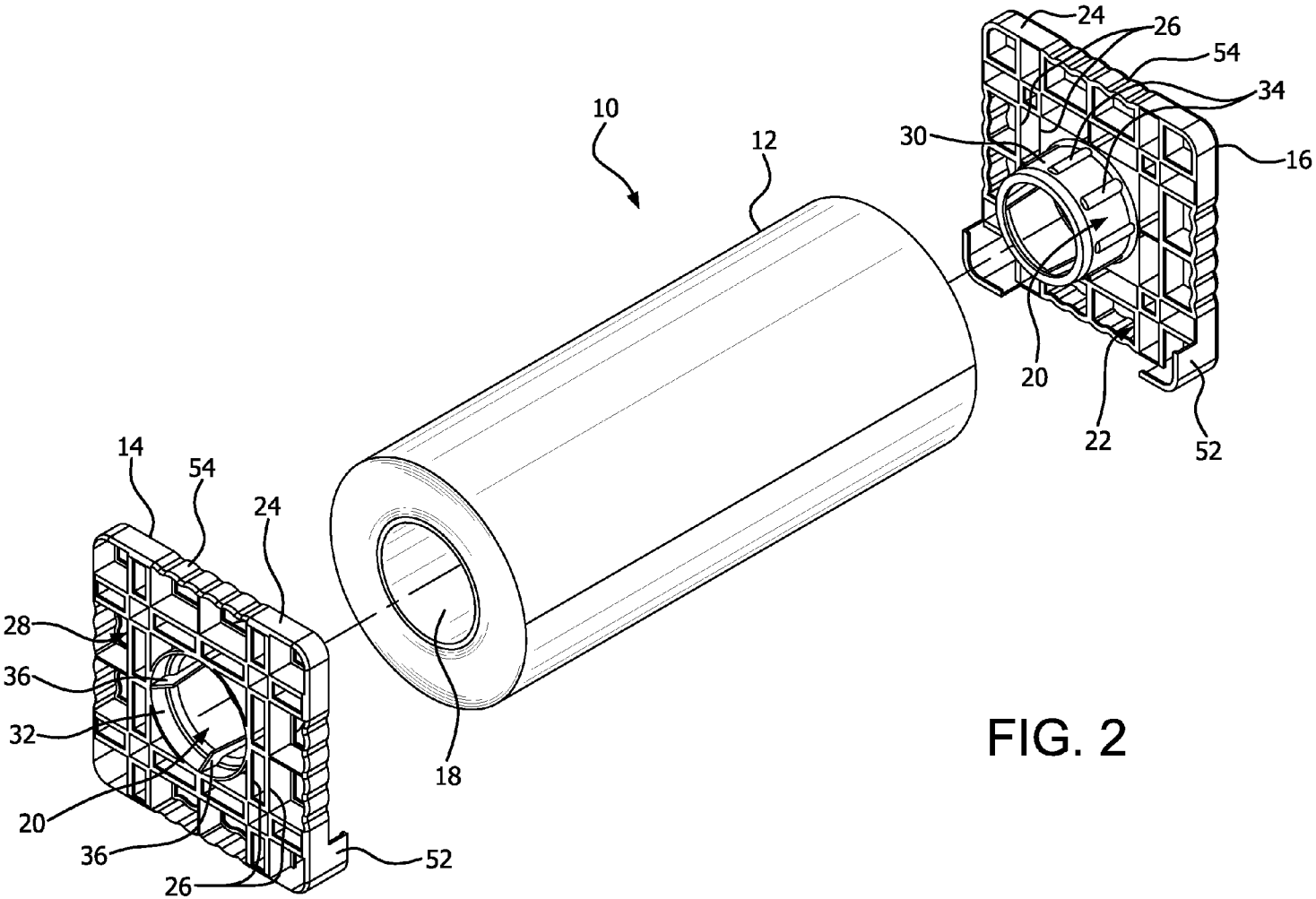
FIG. 2 is an exploded, top perspective view of the package of FIG. 1.

Referring to the drawings, where like numerals identify like elements, there is shown in FIG. 1 the combination of a roll of material and two end supports secured to the ends of the material roll. The combination is generally referred to as a package and is designated in the drawings by the numeral 10. The roll is identified by the numeral 12 and the two end supports are identified to by the numerals 14 and 16. The structure and form of the two supports 14, 16 are contemplated to be the same. The two supports 14, 16 are positioned at the ends of the roll 12. In FIG. 2, the end supports 14, 16 are separated from the roll 12, exposing the tubular core 18 of the roll 12. As shown in FIG. 2, the end support 16 includes a hub 20 projecting from a front face 22. The end support or plate 16 is preferably planar in form and is defined by an outer peripheral flange 24 and a plurality of spaced plate ribs 26. The rear face 28 of the support or plate 14 is shown in FIG. 2, and also forms a generally planar surface. Plate ribs 26 define the thickness of the end supports 14, 16.

Figure 3:
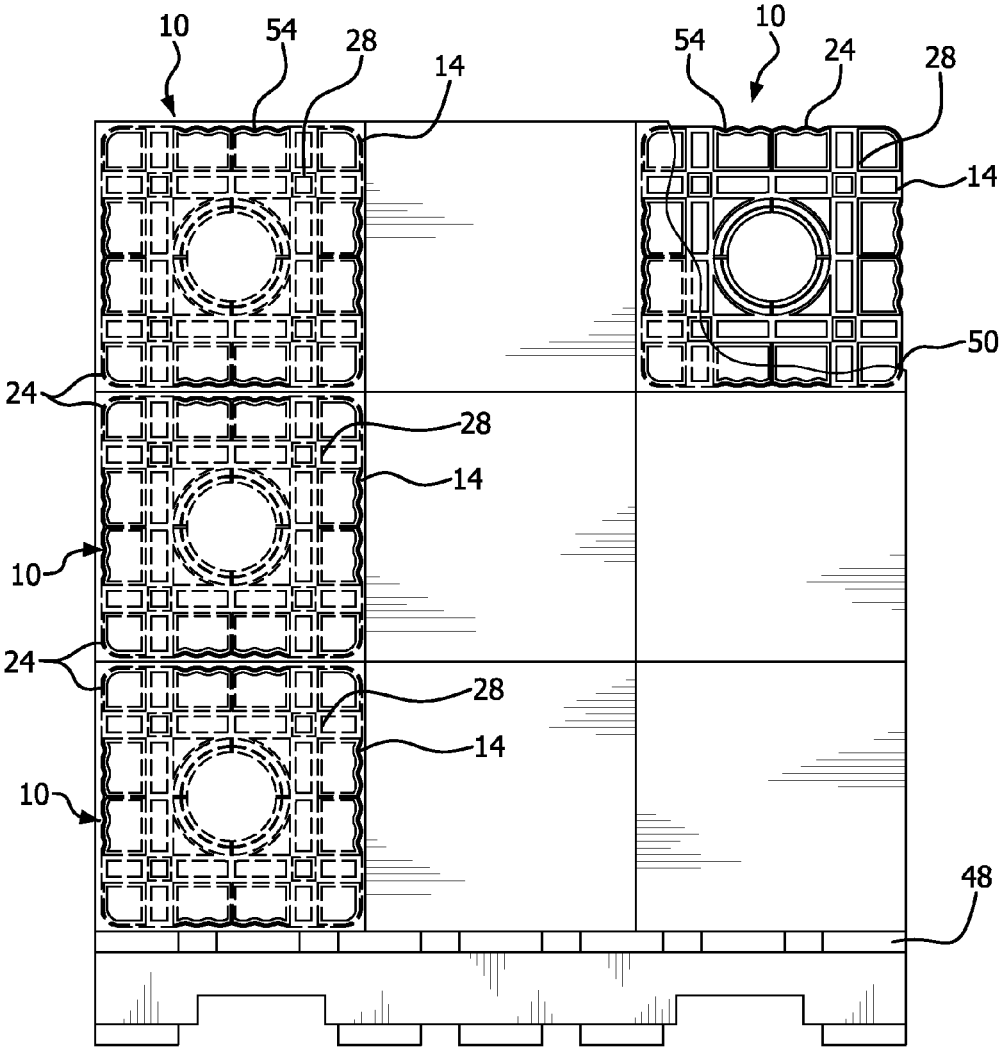
FIG. 3 is a side elevation of the rear face of a plurality of end supports of a plurality of stacked packages.

In FIG. 3, there is shown a plurality of packages 10 stacked on a pallet 48 for shipment and/or storage. The packages 10 are arranged in a grid pattern, with the peripheral flanges 24 of the end supports 14 of adjacent packages 10 being in contact with one another. The end supports 14 within the relatively lower packages in the stack experience a significant greater load due to the weight of the additional package(s) positioned above. Stacking bosses (not shown) may be provided on the periphery of the supports, with the bosses on adjacent supports engaging one another for stabilization of the stacked packages. An outer wrapping 50 may be provided for further stabilization of the stacked and assembled packages 10. Other means (such as straps) may be provided for securing the packages on a pallet (or the like).

Figure 4:
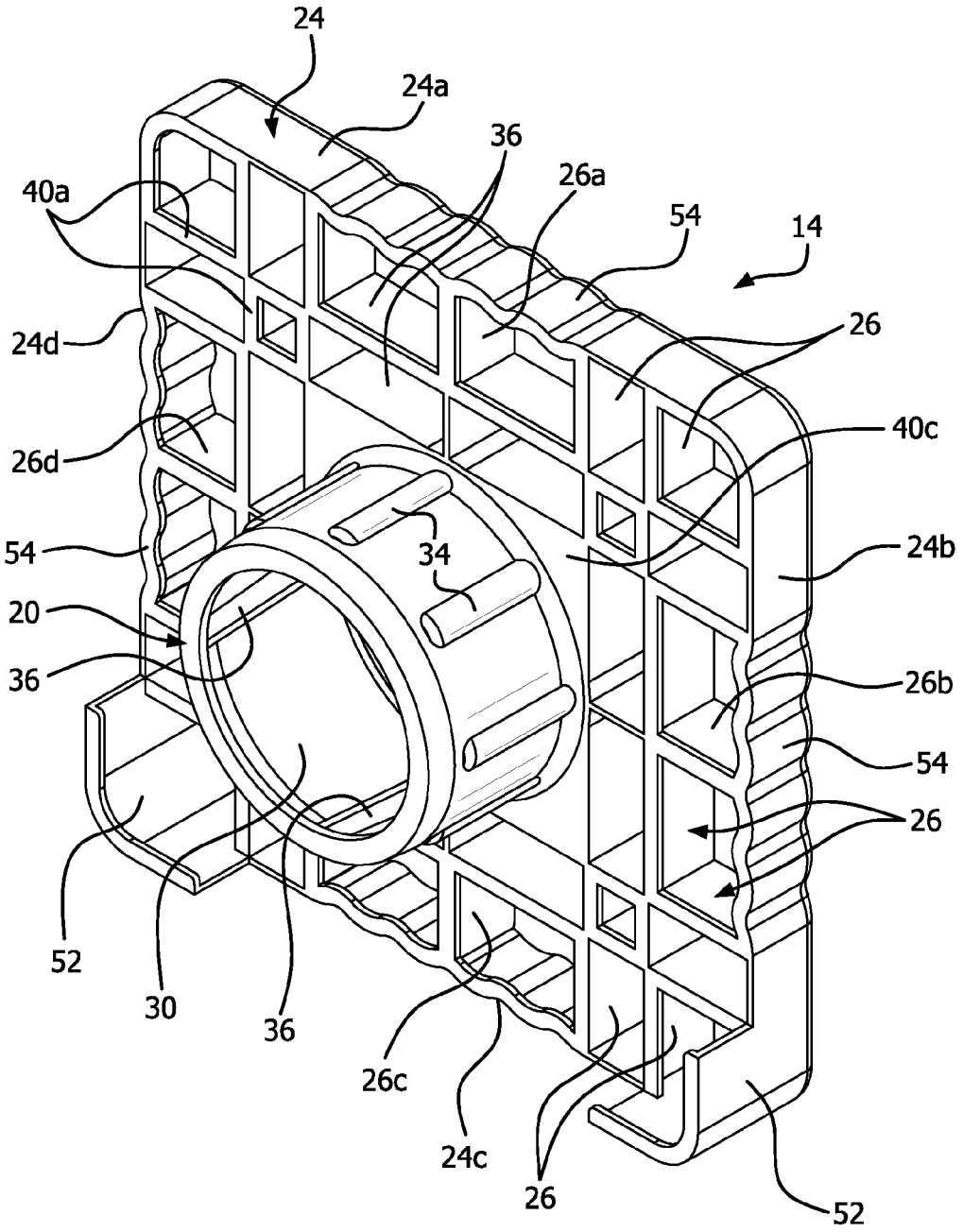
FIG. 4 is a perspective view of the front face of an end support as shown in FIGS. 1-3.
Figure 5:
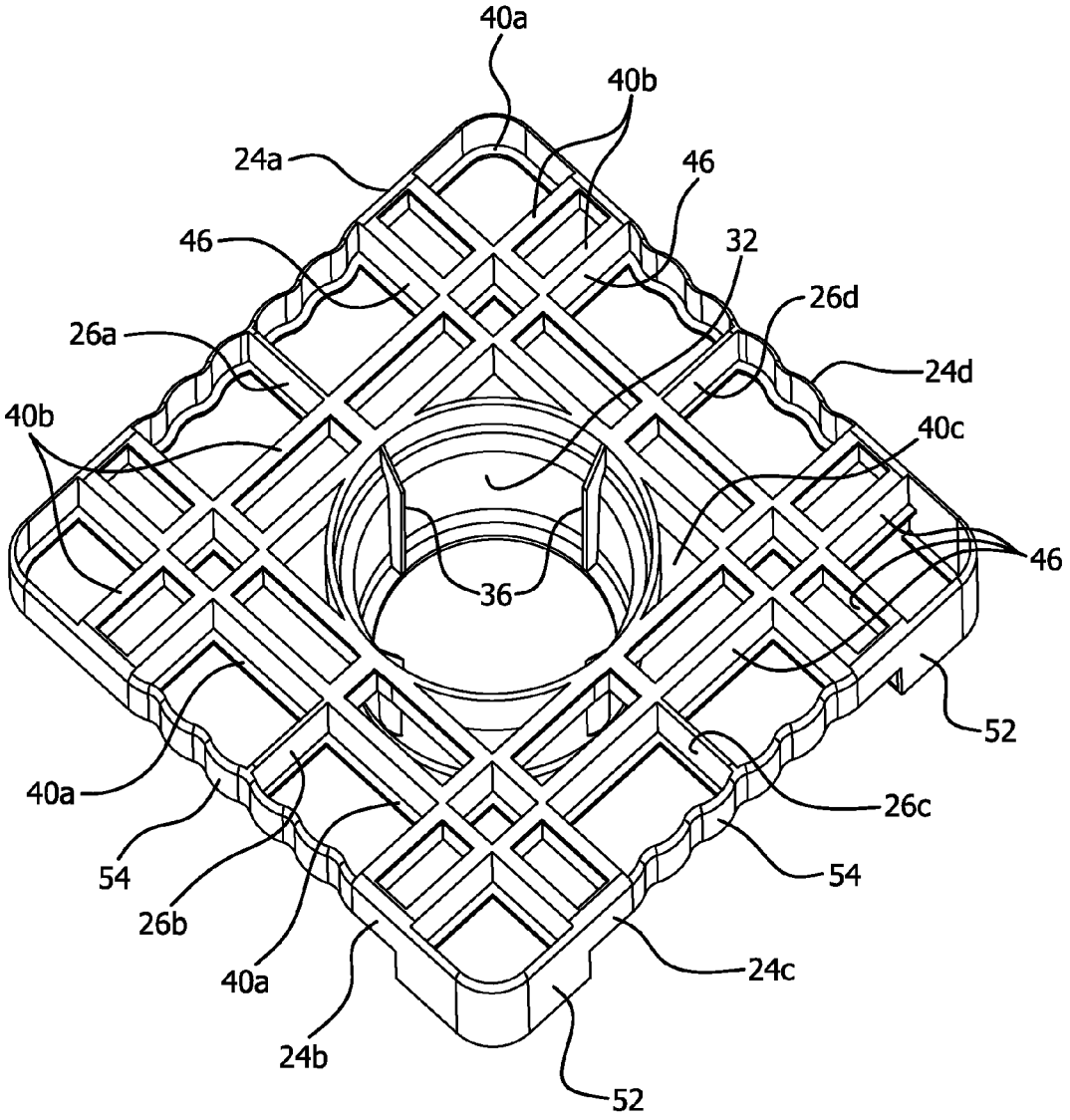
FIG. 5 is a perspective view of the rear face of an end support as shown in FIGS. 1-4.
Figure 6:
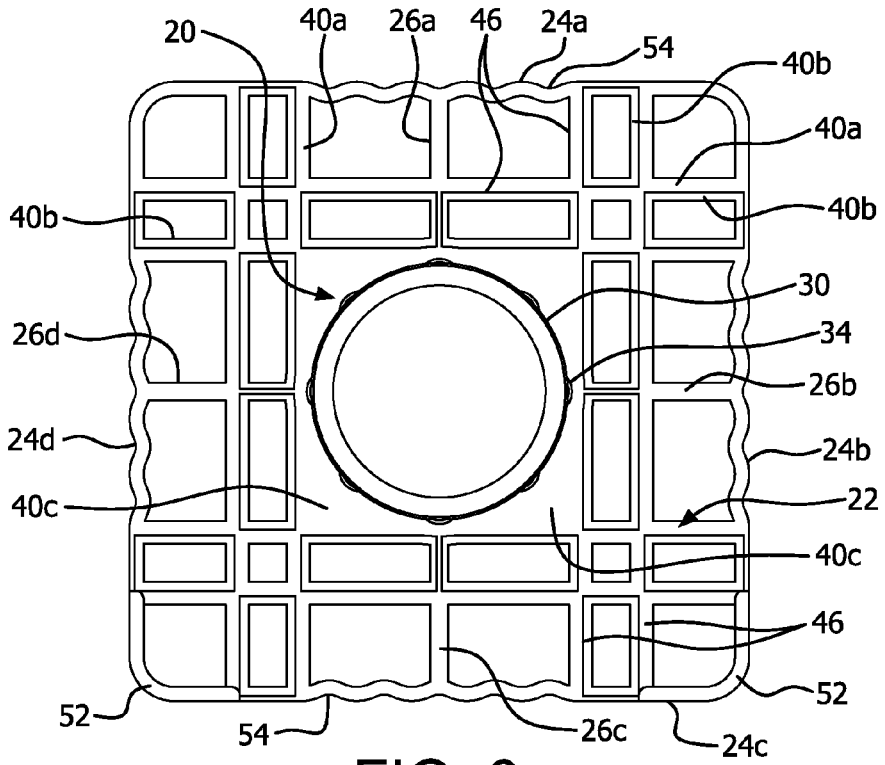
FIG. 6 is an elevation view of the front face of an end support as shown in FIGS. 1-5.
Figure 7:
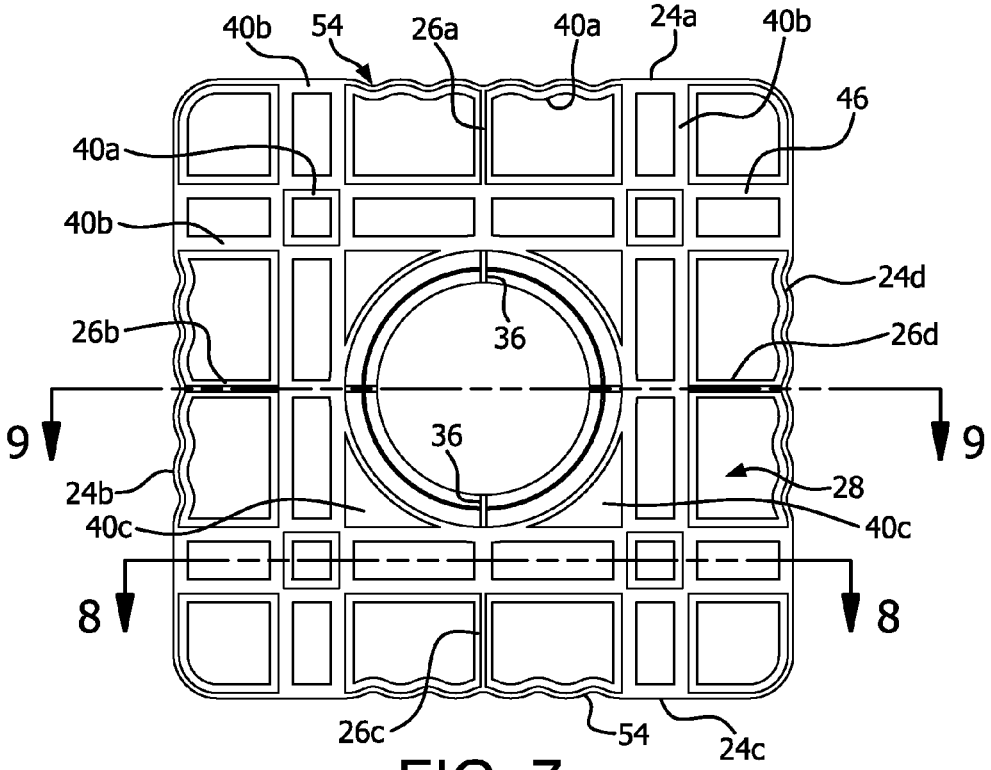
FIG. 7 is an elevation view of the rear face of an end support as shown in FIGS. 1-6.

As shown in at least FIGS. 1, 2 and 4, projecting boss members 52 are provided at the corners of the end supports 14, 16. The projecting bosses 52 assist in stabilizing the supports 14, 16 on a support surface. In the present figures, two bosses 52 are located on two adjacent corners. When assembling the package 10, the bosses are positioned adjacent a support surface (at the bottom of the package). Additional stabilizing bosses may be provided on the other corners of the supports. As shown the bosses 52 project from the front face 22 of the plates 14, 16 and are directed inwardly in the package. The bosses 52 are located outwardly of the outer diameter of the roll 12.

In FIGS. 4-9 there is shown multiple views of one end support 14. The details of the end support 14 are contemplated to be incorporated into the second end support 16. Hence, the second support 16 preferably includes the identical structure.

The peripheral flange 24 of the support 14 defines an outer perimeter and an internal area. The flange 24 includes a number of side surfaces 24*a*, 24*b*, 24*c*, 24*d* arranged to form a generally rectangular periphery. The flange 24 extends transverse to and is preferably perpendicular to the plane of the plate. The plate ribs 26 are also preferably arranged perpendicular to the plane of the plate. The hub 20 is shown as being substantially circular in form and includes an outer dimension defined for insertion into a tubular core 18 of the material roll 12. The material roll 12 is shown as a web that is wrapped around the tubular core 18. The diameter of the roll 12 is contemplated to be limited to the outside dimensions of the support, as measured from the central axis of the hub 20. Hence, in the formed package 10, the roll 12 is spaced from any supporting surface on which the end supports sit.

The hub 20 is centrally positioned within the internal area of the support 14 and includes a projecting portion 30 that extends outwardly from front face 22 and from the plane of the plate. The hub 20 is shown as having a hollow base 32, which is defined within the internal area of the support 14. A plurality of engagement ribs 34 are shown on the outside surface of the hub projection 30 for frictional engagement with the inside hollow of the core 18. A plurality of hub ribs 36 are provided on the inside surface of the generally hollow hub 20. As shown in the cross section of FIG. 9, the internal surfaces of the hub 20 are stepped, with the diameter of the base 32 being greater than the diameter of the projecting portion 30. A shoulder 38 is provided at the connection of the projection 30 and the base 32. The internal hub ribs 36 are shown as having angled inner edges 42 within the area of the base 32.

The positioning of the hub 20 as a projection on the front face 22 of the end support plate 14, with a relatively large load contemplated to be created by the material roll, create a shear or stress concentration at the joint between the front face 22 and the hub projection 30. The internal hub ribs 36 are provided to strengthen the hub 20, particularly in the area of the highest stress/shear.

The plate ribs 36 are positioned within the internal area defined by the outer flange 24. The plate ribs 26 generally extend inwardly from the flange 24. The plate ribs 26 are generally formed perpendicular to side surfaces 24*a*, 24*b*, 24*c*, 24*d*. A series of hub ribs 26*a*, 26*b*, 26*c*, 26*d* extend from the corresponding side surface 24*a*, 24*b*, 24*c*, 24*d* to the base 32 of the hub 20. The hub ribs are perpendicular to the side surfaces of the flange and are aligned with a radius of the hub 20. The plate ribs 26 are shown as having a number of intersections 44 and form a lattice pattern. Hence, the internal area of the plate is generally open between the plate ribs 26. In the lattice pattern shown, the open areas defined between the ribs have a repeating rectangular pattern. Other lattice patterns are possible depending on the form, length and direction of the plate ribs 26 and/or the flange 24.

Within the intersecting lattice pattern, at least one hub rib 26*a*, 26*b*, 26*c*, 26*d* extends substantially perpendicular to a corresponding side edge 24*a*, 24*b*, 24*c*, 24*d* of the peripheral flange 24. The perpendicular hub ribs 26*a*, 26*b*, 26*c*, 26*d* are aligned with a radius of the hub 20. Other plate ribs define crossing ribs 46 and are provided as part of the lattice pattern. The crossing ribs 46 are generally parallel to two of the side edge members and in the rectangular plate shown also perpendicular to two of the side edge members. The crossing ribs 46 in the rectangular lattice pattern are generally perpendicular to two of the hub ribs 26 and are parallel to the other two hub ribs. The open areas within the lattice pattern serve to reduce the material usage in construction and to reduce the overall weight of the plate.

A plurality of corrugation surfaces 40 are fixed to the top and bottom edges of the plate ribs 26 and extending at least partially into the openings between the ribs. The corrugation surfaces 40 are shown as extending along the front face and rear face of the end support plate 14. As more particularly shown in the cross section of FIG. 8, the corrugation surfaces are alternately formed within adjacent openings within the lattice structure. A series of front face corrugations 40*a* are provided along the front face 22 of the plate and a second series of rear face corrugations 40*b* are formed along the rear face 28 of the plate 14. This alternating arrangement serves to stiffen the plate ribs 26 and overall add strength to the end support 14. In the embodiment shown, a hub corrugation surface 40*c* surrounds the hub 20 adjacent the intersection of the base 32 and projection portion 30. The corrugations strengthen the rib structure, while the open areas within the lattice structure reduce weight of the end support plate.

In the embodiment shown, the end support 14 includes a series of outwardly curved (convex) corners 54, with each corner 54 connecting two side surfaces of the peripheral flange 24. A relatively large corner radius is preferred, which will serve to spread the impact load across the end support plate flange and rib structure in the event that the package is dropped or another impact occurs at the corner area or adjacent thereto. The corners may take other forms within departing from the rectangular profile for the side surfaces. For example, the corners may comprise concave surfaces, be formed as angled members, or otherwise formed. The overall perimeter or profile of the end support or plate need not be a rectangle or square. For example, the inclusion of angled corners may overall form an octagonal shaped profile. Four of the side surfaces in the profile correspond to the rectangular side surfaces for the end support plates. The radial hub ribs (26*a-d*) connect to and are positioned transverse to the rectangular side surfaces. Additional radial ribs may be provided to connect to the corners within the profile.

It is preferred that the end support plate include one or more crossing ribs (46) that are parallel to the hub ribs within the lattice configuration. In stacking the packages, a series of vertically positioned plate ribs (26) are provided to withstand the load on the stacked packages. Additional lateral crossing ribs (46) create a plurality of intersections with the vertical ribs and further define the openings within the lattice pattern of the plate. In the embodiment shown, the crossing ribs need not be equidistantly spaced from one another. The openings in the lattice pattern may vary in size.

As shown in the drawings, the side surfaces 24*a-d* of the plate 14 each include an undulating finger portion 54 within the flange wall 24. The open area between the flange and the crossing ribs and the undulations of the finger portion 54 create a relatively comfortable gripping surface for carrying the plate 14 or package. The finger gripping portion may further be formed for matching engagement between side surfaces of two adjacently placed plates, such as the stacking arrangement in FIG. 3. Two or more of the side surfaces may include stacking bosses for further promoting engagement between the side surfaces of two plates.

Figure 8:
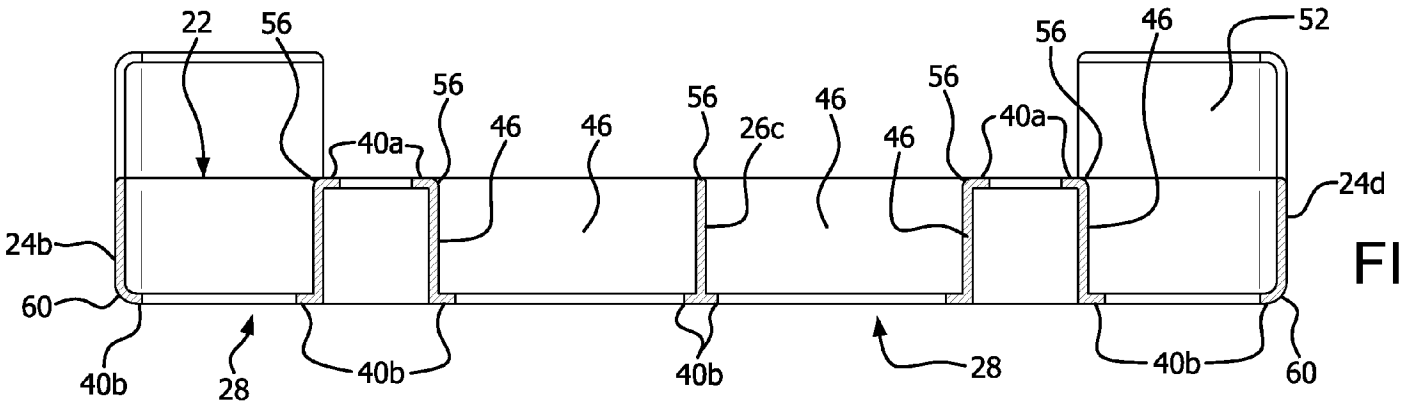
FIG. 8 is a cross sectional view of the end support as taken along line 8-8 in FIG. 7.
Figure 9:
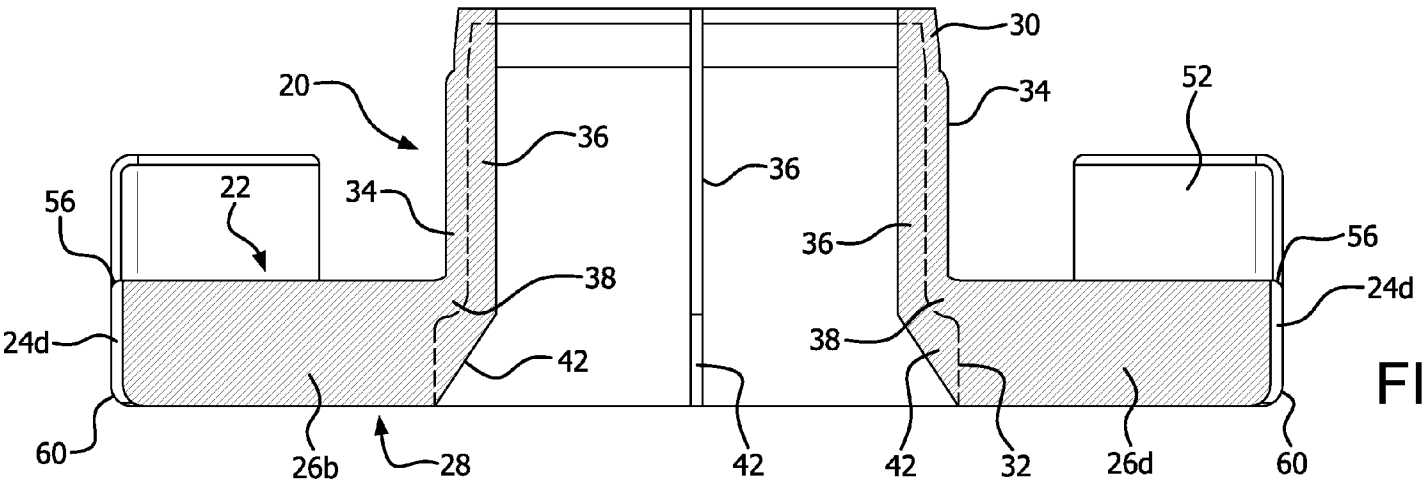
FIG. 9 is a cross sectional view of the end support as taken along line 9-9 in FIG. 7.

In the cross sections of FIGS. 8 and 9, the exposed edges of the plate ribs and the peripheral flange include radius surfaces for creating a positive engagement with contacting structures. On the front face 22 of the end support plate 14, the crossing ribs 46 include corrugation surfaces 40*a*. The ends of the ribs 46 and the projected ends of the corrugation surfaces 40*a* include radiused 56. The front face ends of the peripheral flange 24 also include similar radiused edges 56. These radius edges 56 create positive contact surfaces for the ends of the material roll (12). During shipment and movement of the package, a shifting of the end support plate with respect to the roll may result. Providing a rounded or radiused surface lessen the affects of impact or other movement between the plate and the roll.

In FIG. 9 the projecting portion 30 of the hub 20 is shown in cross section. The outside surfaces of the projecting portion 30 are provided with the engagement ribs 34. It is preferred that the projecting portion 30 and the ribs 34 define a generally cylindrical outer profile, with no drafting or a minimum draft angle. The package 10 is often placed within a box enclosure for protection of the material roll 12 during shipment and storage. During handling and shipment, movement of the package within the box potentially creates shifting of the package elements. The hub 20 preferably creates a relatively tight engagement with the inside surface of the core (18). Drafting of the outside surfaces of the hub may result in the end support plate moving to an offset angle relative to its preferred perpendicular positioning relative to the axis of the roll. The undrafted surface will assist in maintaining the hub in engagement with the tubular core and the front face of the end support plate flush with the ends of the roll.

On the rear face 28 of the end support plates there is provided a radius on the outside edges 60 of the flange 24. The curved edges create a relatively smooth engagement, without binding surfaces that may dig into the surrounding box structure. The radiused surfaces 60 on the flange may further create a structure that is resistive to fracture or deformation upon impact. The outside edges 60 are also helpful in maintaining package integrity in response to environmental impact during handling or dropping of the package.

The use of corrugation surfaces within the openings of the rib lattice is greatly enhanced by alternating the surfaces between the front face and the rear face. The stiffness of the vertical ribs (acting as column-like structures within the stacked plates) is enhanced by the corrugation surfaces without adding significant weight or material to the construction. As shown in the cross section of FIG. 8, a number of the ribs 46 include a front face corrugation surface 40*a* and a rear face corrugation surface 40*b*. However, a single corrugation surface on one face edge is sufficient. Preferably, the corrugation surfaces extend only part of the way into the spaces between the ribs. Hence, an opening is provided within the corrugations. Further, the generally open interior defined by that lattice pattern of the ribs and the alternating corrugation pattern is contemplated to be injection moldable by a relatively simple two part mold.

In the drawings and specification, there is set forth one or more embodiments and, although specific terms are employed, these terms are used in a generic and descriptive sense only and not for purposes of limitation. Additional structure and variations of those structures shown and described are contemplated and will be apparent to those of skill in the art upon a review of the present disclosure. The scope of the invention is set forth by the claims appended hereto.

What is claimed is:

1. An end support for supporting a roll of material wound on a tubular core in a substantially horizontal orientation, the end support comprising:

a substantially planar plate member having a front face and a rear face; the front face and rear face being spaced from one another, the plate having an outer flange defining a number of side surfaces and the side surfaces arranged to form a generally rectangular periphery, the flange extending transverse to the plane of the plate, and an internal area defined within the periphery of the flange;

a substantially circular hub member having an outer dimension defined for insertion into a tubular core of a wound roll of material, the hub centrally positioned within the internal area of the plate and projecting outwardly in a perpendicular direction from the front face and the plane of the plate;

a plurality of spaced plate ribs formed transverse to the plane of the plate and positioned within the internal area, the plate ribs extending inwardly from the outer flange to the hub, a plurality of open areas defined between the plate ribs within the internal area of the plate, and at least one of the plate ribs extending substantially perpendicular to each rectangular side surface of the outer flange, the perpendicular plate ribs aligned with a radius of the circular hub member; and a plurality of corrugation surfaces fixed to the plate ribs and extending from the plate ribs at least partially into the open area between the plate ribs; the corrugation surfaces alternately formed along the front and rear faces of the plate.

2. An end support as in claim 1 wherein said hub member is substantially hollow and comprises an internal wall, and wherein a plurality of hub rib portions are formed within the hub member and extend axially along the internal wall of the hub member.

3. An end support as in claim 2 wherein the hub rib portions are aligned with the perpendicular plate ribs.

4. An end support as in claim 3 wherein the hub rib portions extend radially from the internal wall only partially into the central area of the hub member.

5. An end support as in claim 1 wherein the side surfaces of the outer flange are formed by four flat side members, and wherein rounded corners connect the side members.

6. An end support as in claim 5 wherein the plate ribs further comprise a plurality of ribs extending radially between the hub member and the corners of the outer flange.

7. An end support as in claim 1 wherein the plate ribs further comprise a plurality of parallel ribs positioned within the internal area and aligned substantially parallel to the side members of the outer flange.

8. An end support as in claim 7 wherein the parallel ribs intersect with the perpendicular plate ribs.

9. An end support as in claim 8 wherein the parallel ribs and perpendicular plate ribs form an open lattice structure within the rectangular periphery and wherein the corrugation surfaces have a rectangular form within the lattice openings.

10. An end support as in claim 1 wherein the side surfaces of the plate each comprise an undulating wall portion creating a hand gripping portion for the plate.

11. An end support for supporting a roll of material wound on a tubular core in a substantially horizontal orientation, the end support comprising:

a plate having four side members, the side members forming a rectangular profile, the plate having four corners members, each corner member connecting two of the side members, and the plate having a front face and a rear face, the front and rear faces being spaced from one another by a plate thickness;

a hub member having an outer dimension defined for insertion into a tubular core of a wound roll of material, the hub centrally positioned within the rectangular profile of the plate member and projecting substantially perpendicular from the front face of the plate;

a plurality of spaced plate ribs provided internally within the rectangular profile of the plate, at least one of the plate ribs extending inwardly from each of the side members and substantially perpendicular thereto, each of the perpendicular plate ribs connected to the hub member;

wherein the side members, corner members, hub member and plate ribs define generally open areas there between within the plate; and a plurality of corrugation surfaces fixed to one or more of the side members, corner members, hub member and plate ribs and at least partially into the open areas, the corrugation surfaces alternately formed along the front and rear faces of the plate.

12. An end support as in claim 11 further comprising a plurality of plate ribs intersecting the perpendicular plate ribs.

13. An end support as in claim 11 further comprising radius surfaces on the plate ribs at the front face and rear face of the plate.

14. An end support as in claim 11 further comprising a plurality of plate ribs angled inwardly from the side members.

15. An end support as in claim 11 further comprising corners members having outwardly convex surfaces.

16. An end support as in claim 11 wherein the hub member is generally cylindrical and comprises a substantially hollow interior.

17. An end support as in claim 16 wherein the perpendicular plate ribs are aligned with a radius of the cylindrical hub member.

18. An end support as in claim 17 wherein said hub member comprises a plurality of hub rib portions formed along an internal wall portion within the hollow of the cylindrical hub member.

19. An end support as in claim 18 wherein a number of the hub rib portions are aligned with the perpendicular plate ribs.

20. An end support as in claim 19 wherein the hub rib portions extend only partially from the internal wall portion into the central area of the hub member.

* * * * *